United States Patent [19]

Sraka et al.

[11] Patent Number: 4,700,987

[45] Date of Patent: Oct. 20, 1987

[54] FOLDING TABLE MECHANISM

[76] Inventors: Stanko Sraka, 267 Jeffcoat Drive, Rexdale, Ontario, Canada, M9W 3E4; Robert Sraka, 5 Chalfont Road, Rexdale, Ontario, Canada, M9W 3S1

[21] Appl. No.: 948,117

[22] Filed: Dec. 31, 1986

[51] Int. Cl.[4] ..... A47B 3/14

[52] U.S. Cl. ..... 297/159; 108/113

[58] Field of Search ..... 297/159, 147, 139; 108/35, 113

[56] References Cited

U.S. PATENT DOCUMENTS 1,115,731 11/1914 Owens ..... 108/35
3,337,262 8/1967 Katzfey et al. ..... 108/113 X
3,777,674 12/1973 Parsons ..... 108/113
3,799,073 3/1974 Nielsen ..... 108/113
4,249,773 2/1981 Giambalvo ..... 297/159

*Primary Examiner*—Kenneth J. Dorner
*Assistant Examiner*—Peter R. Brown
*Attorney, Agent, or Firm*—D. Ron Morrison

[57] ABSTRACT

The mechanism provides a folding table structure suitable for picnic tables and the like which may be folded to assume a generally vertical storage position. The folding action folds the top, the seating portions and the legs in one action. Elements of the mechanism include a riser frame with table top supports, seats, and legs each pivotally attached to the frame, a brace pivotally and slidably connecting the table top supports and seats, and a link pivotally and slidably connecting the brace and the riser frame.

12 Claims, 7 Drawing Figures

FOLDING TABLE MECHANISM

This invention relates to table construction and more particularly to a table mechanism which may be folded in one motion so that the top, the seating and the legs assume a generally vertical position for compact transportation and storage. The top, seating and legs co-act for mutual support when in use, during folding and in storage.

An object of the present invention is to provide a folding table mechanism with a minimum of linkages and supports for ease of use and manufacture while being durable.

Another object of the present invention is to provide a folding table mechanism which can be readily folded as a unit into a plurality of vertical planes closely spaced from each other and from a central frame to minimize the space required for transportation and storage and for ease of carriage.

Another object of the present invention is to provide a folding table mechanism which is self-supporting in both the extended, (operative or in-use) position and in the folded (storage) position without need for one or more latches to retain the table extended for use or folded for transportation or storage.

The invention thus consists of a folding table comprising a rise frame, a table top support pivotally secured to said riser frame about a first horizontal axis for pivotal movement between a horizontal operative position and a folded storage position, seat means pivotally secured to said riser frame about a second axis, parallel to and below said first horizontal axis, for pivotal movement of the seat means generally parallel to movement of said table top support, leg means pivotally secured to said riser frame about a third parallel axis (optionally co-axial with said first horizontal axis) for pivotal movement of the leg means below said table top support between an extended position, in which said leg means forms an acute angle with the table top support and supports said table in operative position, and a folded storage position, a generally vertical table top brace means pivotally connected to said seat means at a first end thereof to pivot about a fourth parallel axis in spaced relation to said second axis and slidably received at the second end thereof in said table top support for sliding movement in the plane of said table top support, and link means pivotally connected to said frame at a first end thereof to pivot about a fifth parallel axis intermediate said first axis and said second axis and slidably received at the second end thereof in said table top brace means for sliding movement along a portion of the length of said table top brace means, wherein said leg means is slidably received in said link means for sliding along a portion of the length of said link means between a first position, in which said leg means supports said seat means in a generally horizontal position, and a second position in which said leg means is in a folded storage position.

The invention further consists in a folding table comprising a central frame means, a pair of table top support means pivotally secured to opposing sides of said frame means about transversely spaced first parallel horizontal axes for pivotal movement between a horizontal flat operative position and a folded storage position, a pair of seat means pivotally secured to opposing sides of said frame means at second axes, parallel to and below said first axes respectively, for pivotal movement of the seat means generally parallel to movement of said pair of table top support means, a pair of leg means pivotally secured to opposing sides of said frame means about third parallel axes (optionally co-axial with said respective first axes) for pivotal movement of the leg means below said table top support means between an extended position, in which said leg means forms an acute angle with the respective table top support and supports the table in operative position, and a folded storage position, a pair of generally vertical table top brace means, each pivotally connected to a respective one of said seat means at the lower end thereof and each slidably and pivotally connected to a respective one of said table top support means at the upper end thereof, to pivot at the lower ends thereof about fourth axes parallel to said first axes, the upper ends each being slidably received in corresponding ones of said table top support means for sliding movement in the plane of said table top support means, and a pair of link means, each pivotally connected to said frame at a first end thereof about fifth parallel axes intermediate corresponding ones of said first axes and said second axes and being pivotally connected to corresponding ones of said table top brace means for sliding movement along the length of said table top brace means, wherein each of said leg means is slidably received in a respective said link means for sliding along a portion of the length of said link means between a first position in which said leg means supports said seat means in a generally horizontal position and a second position in which said leg means is in a folded storage position.

BRIEF LIST OF DRAWINGS

DESCRIPTION OF THE PREFERRED EMBODIMENT

Figure 1:
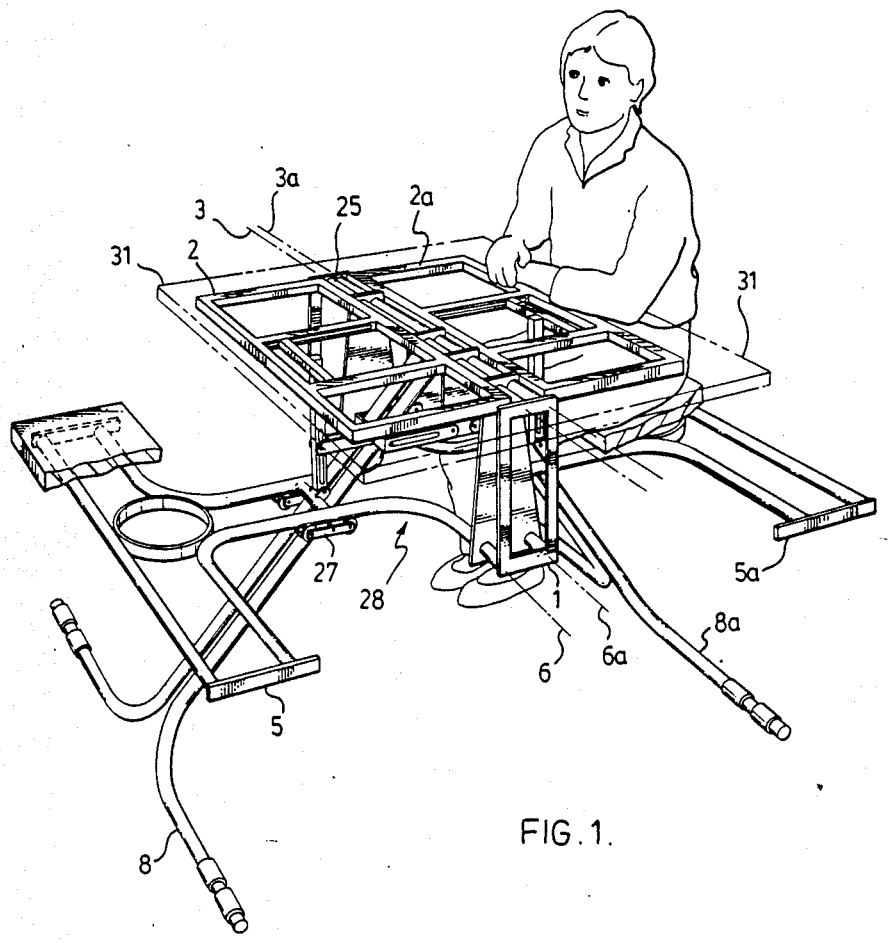
FIG. 1 is a perspective view of a preferred embodiment of the invention shown in the fully extended or operative position.

Referring now in detail to the preferred embodiment of the invention illustrated in the accompanying drawings, FIG. 1 shows the folding table mechanism generally designated 28 in the extended or operative position. Table mechanism 28 folds about a central riser frame 1 from the extended position for use (fig 1) to the fully folded position shown in FIG. 3.

Frame 1 is generally vertical when the table 28 is in the operative position. Table top supports 2 and 2*a* are pivotally connected to frame 1 about parallel first horizontal axes 3 and 3*a*. As may be seen from FIGS. 1, 2, and 4, a two-part top 31 of any suitable shape may be affixed to the upper side of top supports 2 and 2*a*. Seat portions 5 and 5*a* are pivotally connected to frame 1 about parallel second axes 6 and 6*a* for movement generally parallel to corresponding ones of the table top supports 2 and 2*a* respectively.

Leg portions 8 and 8*a* are pivotally connected to frame 1 about third parallel horizontal axes 9 and 9*a* (FIG. 2 and 3) which are shown as adjacent first axes 3 and 3*a*, but optionally may be co-axial respectively therewith. Preferably axes 9 and 9*a* are parallel with and intermediate first longitudinal axes 3 and 3*a*.

Figures 4, 7:
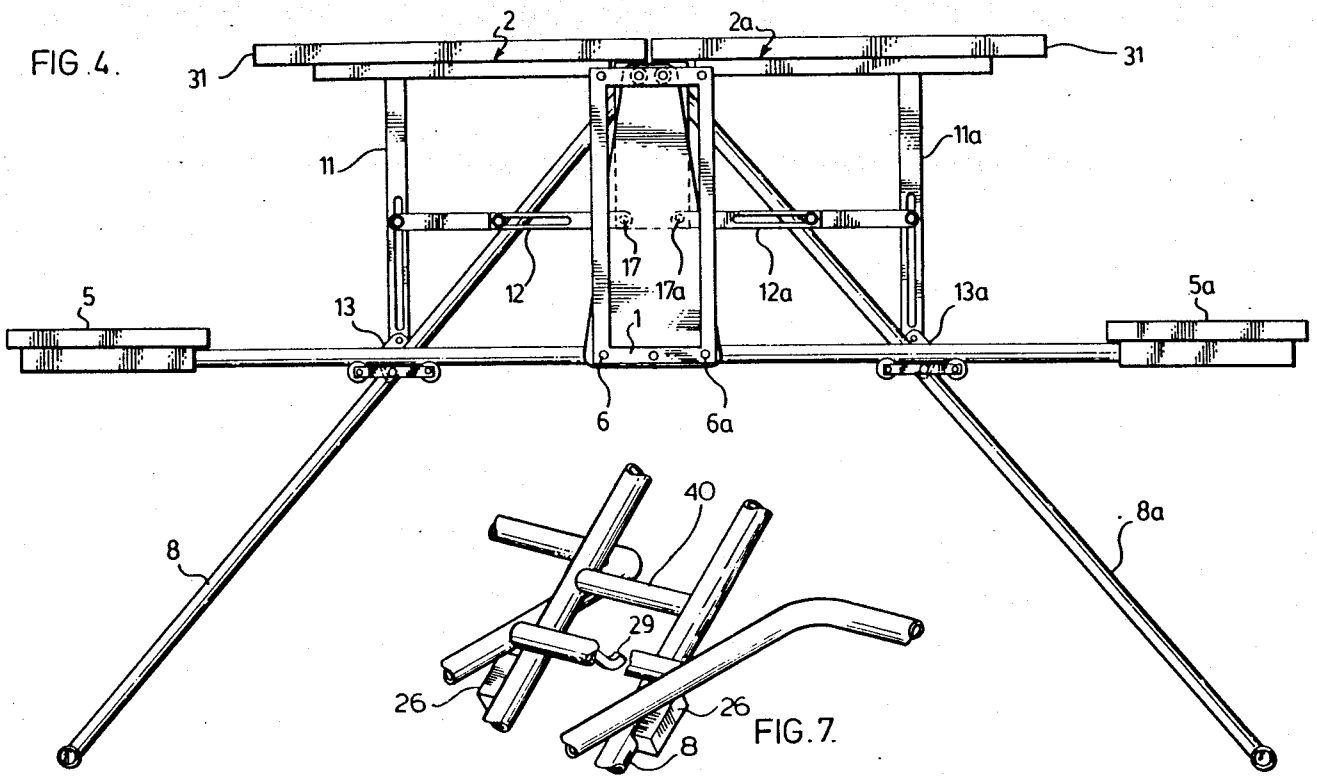
FIG. 4 is an elevation of a preferred embodiment of the invention shown in the fully extended position.
FIG. 7 is a perspective view of a portion of another embodiment of the invention.

As shown in FIG. 4, structural rigidity and interactive folding are provided by a pair of table top brace means 11 and 11*a* and a pair of links 12 and 12*a*. Table top brace pair 11 and 11*a* are generally vertical and parallel to frame 1; they are connected between pivotal connections 13 and 13*a*, to pivot around parallel fourth horizontal axes on leg portions 8 and 8*a*, and sliding and pivotal connections 14 and 14*a* on table top supports 2 and 2*a* (FIGS. 2 and 4).

Figure 6:
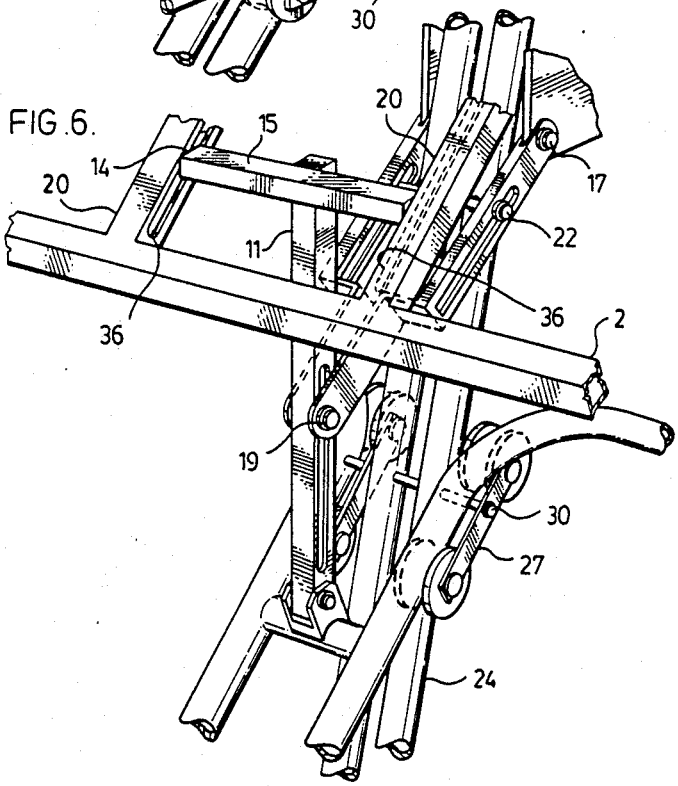
FIG. 6 is a perspective view of a portion of the table mechanism in a partially folded position.

Detail of connection 14 is shown in FIG. 6. A first brace 11 is rigidly connected to cross-member 15 preferably at about its center point. Cross-member 15 is slidably received in a pair of channels 36 in table top support member 20 for pivotal movement about cross-member 15 as axis and for sliding movement in relation to the table top support.

Figure 2:
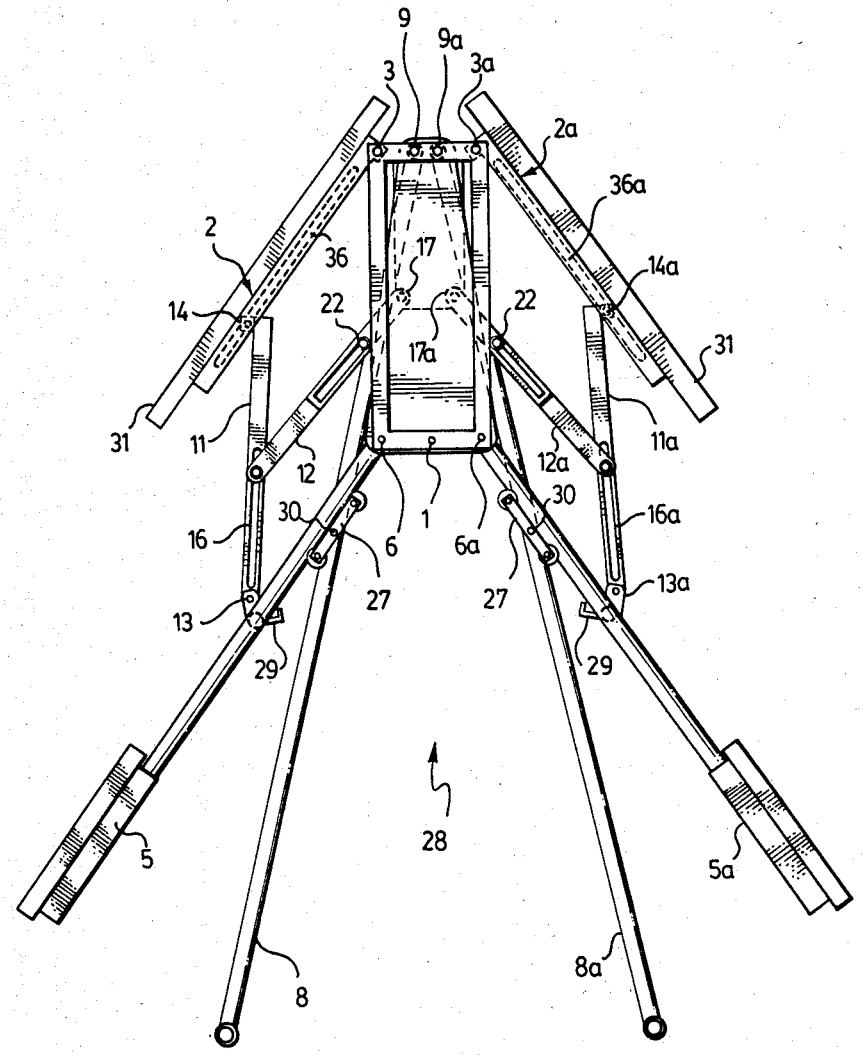
FIG. 2 is an elevation of a preferred embodiment of the invention shown in a partially folded position.

Table top braces 11 and 11*a* are provided with slots 16 and 16a intermediate their ends (FIG. 2).

Figure 5:
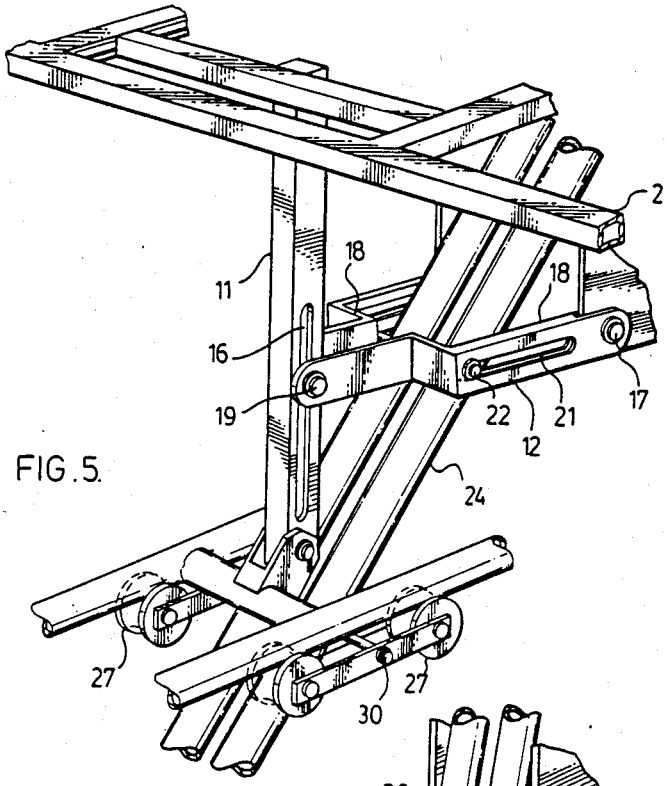
FIG. 5 is a perspective view of a portion of the table mechanism in the fully extended position.

Each one of a pair of links 12 and 12*a* is pivotally connected to frame 1 for pivotal movement about fifth parallel horizontal axes 17 and 17*a* (FIG. 2) intermediate the first axes 3 and 3*a* and the second axes 6 and 6*a* respectively. As is more clearly seen in FIG. 5, each of the links 12 consists of two longitudinal portions 18 and a lateral end portion 19. Each lateral end portion 19 is slidably and pivotally received in one of slots 16 and 16*a*. Each of the longitudinal portions 18 includes a slot 21 along its length for slidably and pivotally receiving a pin 22 (FIGS. 5 & 6).

Figure 3:
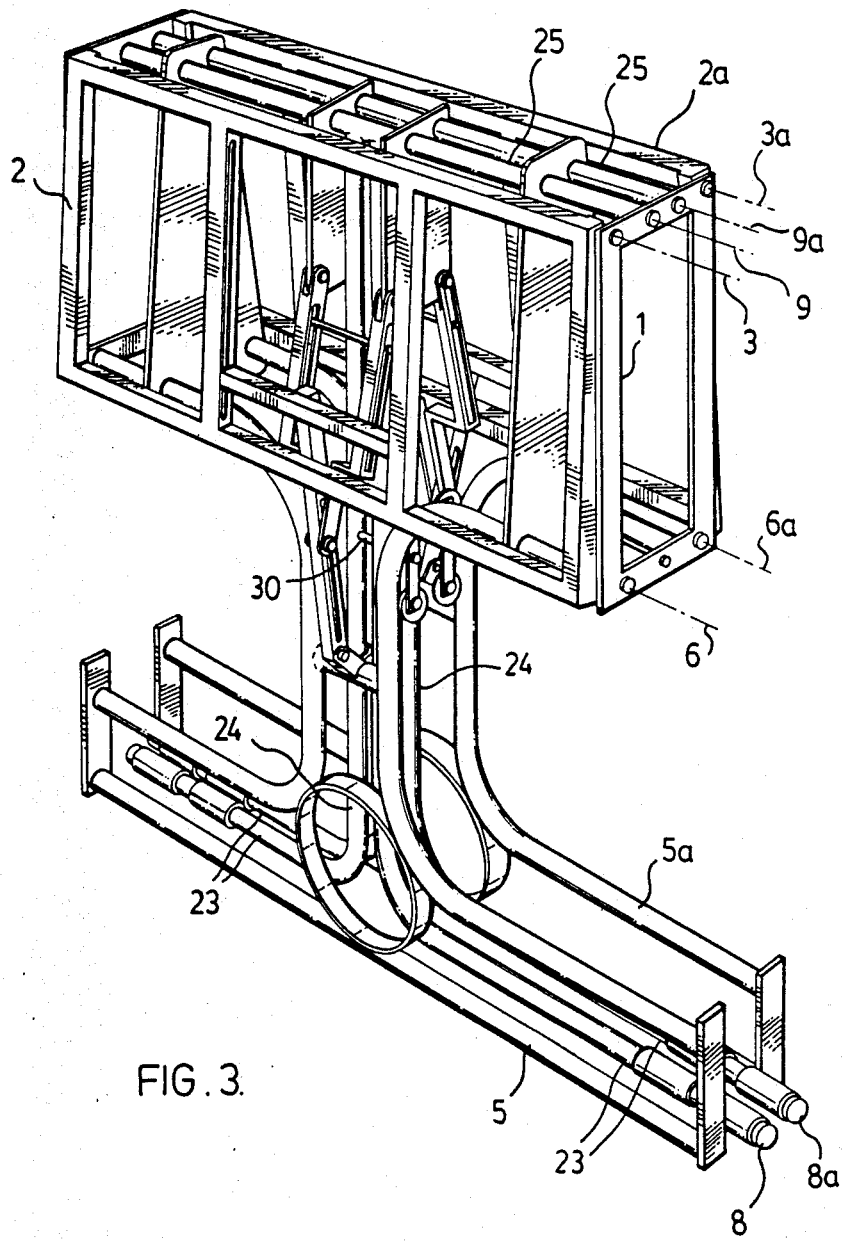
FIG. 3 is a perspective view of a preferred embodiment of the mechanism of the invention (minus table top parts), shown in the fully folded position ready for transportation or storage.

As can be seen in FIG. 3, the leg portions 8 and 8*a* comprise base members 23, leg members 24 and lateral members 25. Each lateral member 25 forms a part of third horizontal axes 9 and 9*a* respectively.

As shown in FIG. 7, a stop member 26 may be provided intermediate base member 23 and lateral member 25, to support the seat means when in operative position. Seat portions 5 may include a depending hook 29 which co-acts with a cross member 40 on each of leg portions 8 and 8*a* to prevent relative motion between seat portions 5 and 5*a* and leg portions 8 and 8*a* when the table mechanism is in its fully extended or operative position. Optionally and preferably stop member 26 can be replaced with pivoted pairs of rollers 27 as shown in the other figures, the pairs pivoting on pivot pins 30 in leg members 24.

Although the preferred embodiment of the foldable table mechanism has been described, it will be appreciated within the scope of the invention that the angular relationships of the various components of the table mechanism may be altered and still provide an operative structure.

Likewise it will be appreciated that the embodiment described and illustrated in detail has a symetrical arrangement of a duplicate set of parts that are mirror images of one another, arranged so that in the operative position the table is free standing and self supporting; however, as claimed the invention includes a table that has only one set of parts as detailed, provision being made in the riser frame to fasten the frame to a supporting structure, for example a wall or fence, against which the table can be folded or extended for use.

What we claim is:

1. A folding table comprising:

(a) a riser frame, (b) a table top support pivotally secured to said riser frame about a first horizontal axis for pivotal movement between a horizontal operative position and a folded storage position, (c) seat means pivotally secured to said riser frame about a second axis, parallel to and below said first horizontal axis, for pivotal movement of the seat means generally parallel to movement of said table top support, (d) leg means pivotally secured to said riser frame about a third parallel axis for pivotal movement of the leg means below said table top support between an extended position, in which said leg means forms an acute angle with the table top support and supports said table in operative position, and a folded storage position, said third parallel axis optionally being co-axial with said first horizontal axis, (e) a generally vertical table top brace means pivotally connected to said seat means at a first end thereof to pivot about a fourth parallel axis in spaced relation to said second axis and slidably received at the second end thereof in said table top support for sliding movement in the plane of said table top support means, and (f) link means pivotally connected to said riser frame at a first end thereof to pivot about a fifth parallel axis intermediate said first axis and said second axis and slidably received at the second end thereof in said table table top brace means for sliding movement along a portion of the length of said table top brace means, wherein said leg means is slidably received in said link means for sliding along a portion of the length of said link means between a first position, in which said leg means supports said seat means in a generally horizontal position, and a second position in which said leg means is in a folded storage position.

2. A folding table as claimed in claim 1 further comprising additional support means on said leg means to suppport said seat means when in the operative position.

3. A folding table as claimed in claim 2 wherein said seat means further comprises depending hook means adapted to releasably retain said leg means in said operative position.

4. A folding table as claimed in claim 1 wherein said seat means comprises an extended seat portion generally parallel to said horizontal axes and an arm portion extending between said extended seat portion and said second axis intermediate the ends of the said seat portion.

5. A folding table as claimed in claim 4 wherein said table top brace means is connected to said seat means intermediate the ends of said arm portion.

6. A folding table as claimed in claim 1 wherein said leg means comprises a leg portion generally perpendicular to said third axis and an extended base portion remote from said third horizontal axis.

7. A folding table comprising:

(a) a central frame means, (b) a pair of table top support means pivotally secured to opposing sides of said frame means about transversely spaced first parallel horizontal axes for pivotal movement between a horizontal flat operative position and a folded storage position, (c) a pair of seat means pivotally secured to opposing sides of said central frame means at second axes, parallel to and below said first axes respectively, for pivotal movement of the seat means generally parallel to movement of said pair of table top support means, (d) a pair of leg means pivotally secured to opposing sides of said central frame means about third parallel axes for pivotal movement of the leg means below said table top support means between an extended position, in which said leg means forms an acute angle with the respective table top support and supports the table in operative position, and a folded storage position, said third parallel axes optionally being co-axial with said respective first axes, (e) a pair of generally vertical table top brace means, each pivotally connected to a respective one of said seat means at the lower end thereof and each slidably and pivotally connected to a respective one of said table top support means at the upper end thereof to pivot at the lower ends thereof about fourth axes parallel to said first axes, the upper ends each being slidably received in corresponding ones of said table top support means for sliding movement in the plane of said table top support means, and (f) a pair of link means, each pivotally connected to said central frame at a first end thereof about fifth parallel axes intermediate corresponding ones of said first axes and said second axes and being pivotally connected to corresponding ones of said table top brace means for sliding movement along the length of said table top brace means, wherein each of said leg means is slidably received in a respective said link means for sliding along a portion of the length of said link means between a first position in which said leg means supports said seat means in a generally horizontal position and a second position in which said leg means is in a folded storage position.

8. A folding table as claimed in claim 7 further comprising additional support means on said leg means to support said seat means when in the operative position.

9. A folding table as claimed in claim 8 further comprising depending hook means adapted to a releasably retain said leg means in said operative position.

10. A folding table as claimed in claim 7 wherein each said seat means comprises an extended seat portion generally parallel to said horizontal axes and an arm portion extending between said extended seat portion and its respective second axis intermediate the ends of the said seat portion.

11. A folding table as claimed in claim 10 wherein each said table top brace means is connected to its respective seat means intermediate the ends of said arm portion.

12. A folding table as claimed in claim 7 wherein said leg means comprises a leg portion generally perpendicular to said third parallel axis and an extended base portion remote from said third parallel axis.

* * * * *